US008807016B2

(12) United States Patent
Beumer

(10) Patent No.: US 8,807,016 B2
(45) Date of Patent: Aug. 19, 2014

(54) HYDRAULIC CYLINDER AND METHOD FOR THE MANUFACTURE THEREOF

(75) Inventor: Jan Albertus Beumer, Lochem (NL)

(73) Assignee: Actuant Corporation, Menomonee Falls, WI (US)

( * ) Notice: Subject to any disclaimer, the term of this patent is extended or adjusted under 35 U.S.C. 154(b) by 987 days.

(21) Appl. No.: 12/933,167

(22) PCT Filed: Mar. 18, 2009

(86) PCT No.: PCT/NL2009/000065
§ 371 (c)(1),
(2), (4) Date: Oct. 18, 2010

(87) PCT Pub. No.: WO2009/116857
PCT Pub. Date: Sep. 24, 2009

(65) Prior Publication Data

US 2011/0030553 A1 Feb. 10, 2011

(30) Foreign Application Priority Data

Mar. 19, 2008 (NL) ..... 2001389

(51) Int. Cl.
*F15B 15/14* (2006.01)

(52) U.S. Cl.
USPC ..... 92/169.1; 92/168

(58) Field of Classification Search
USPC ..... 92/128, 168, 169.1
See application file for complete search history.

(56) References Cited

U.S. PATENT DOCUMENTS 3,494,652 A * 2/1970 Langland ..... 92/128
5,680,808 A * 10/1997 Day et al. ..... 92/168
5,778,760 A * 7/1998 Yuda ..... 92/151
6,263,779 B1 * 7/2001 Oliver et al. ..... 92/128

FOREIGN PATENT DOCUMENTS

DE 44 33 649 A1 11/1995
DE 4433649 A1 * 11/1995

OTHER PUBLICATIONS

International Search Report under date of Jun. 26, 2009 for International Patent Application PCT/NL2009/000065.
Search Report from NL Patent Application 2001389.

* cited by examiner

*Primary Examiner* — Thomas E Lazo
(74) *Attorney, Agent, or Firm* — Michael Best & Friedrich LLP

(57) ABSTRACT

A hydraulic cylinder comprising:
- a cylinder body which has an open end with an opening and an edge extending therearound, which cylinder body also has an inner surface;
- a piston rod;
- a close-off member which has an insert part, which insert part protrudes in a fitting manner into the open end of the cylinder body, which insert part has an outer circumferential face, wherein the close-off member also has a flange opposing the edge of the cylinder body;
- coupling means which are operable between the inner surface of the cylinder body and the outer circumferential face of the insert part for securing, in at least one axial direction, the close-off member in the cylinder body, and
- a clamping ring which is clamped between the flange and the edge at the open end of the cylinder body.

The clamping ring is made of a resilient, compressible material, in particular is made of an elastomer. The clamping ring is clamped, when compressed in the axial direction, between the flange and the edge at the open end.

20 Claims, 2 Drawing Sheets

HYDRAULIC CYLINDER AND METHOD FOR THE MANUFACTURE THEREOF

CROSS-REFERENCE TO RELATED APPLICATIONS

This application is a national stage filing under 35 U.S.C. 371 of PCT International Application No. PCT/NL2009/000065 filed on Mar. 18, 2009, which claims foreign priority to Netherlands Patent Application No. 2001389 filed Mar. 19, 2008, the entire contents of all of which are incorporated herein by reference. Priority to each application is hereby claimed.

FIELD OF THE INVENTION

The present invention relates to a hydraulic cylinder. The present invention also relates to a method for coupling a close-off member to a cylinder body of a hydraulic cylinder.

BACKGROUND OF THE INVENTION

A cylinder having a close-off member mounted thereon is for example known from US patent publication U.S. Pat. No. 6,263,779. That document describes a method for coupling a close-off member, such as a close-off cover or a gland, for guiding a piston rod of a hydraulic damper of a vehicle suspension system, with a cylinder body of a damper of this type. The cylinder body has an open end with an edge and has on an inner surface a peripheral groove. This groove is formed set apart from the edge. The close-off member has an insert part having an outer surface which is introduced into the open end of the cylinder body. The close-off member also has a flange which extends in the radial direction and is located, after mounting of the close-off member, opposite the edge of the cylinder body. A second peripheral groove, wherein a spring ring is attached, is formed in the outer surface of the insert part for coupling the close-off member to the cylinder body in interaction with the first peripheral groove. A steel snap ring, which is divided in one location, is attached between the flange and an upper side of the edge of the cylinder body.

In this method known from U.S. Pat. No. 6,263,779, the close-off member is mounted in the cylinder body by feeding the insert part into the open end of the cylinder body and further displacing it therein until the two grooves oppose each other and the spring ring falls into the peripheral receiving space which is produced and couples both components to each other. As a result of the shape of both grooves, the spring ring is secured in a form-fitting manner in the receiving space when the close-off member is subsequently drawn out from the cylinder body somewhat. Afterwards, a steel snap ring having suitable dimensions is selected and placed between the flange and the edge of the cylinder body.

It is a drawback of this hydraulic cylinder known from U.S. Pat. No. 6,263,779 with a close-off member and this known method for coupling the close-off member that the placing of the steel snap ring takes place once the close-off member is already coupled to the cylinder body. The steel snap ring has to be attached afterwards, necessitating special equipment. In addition, owing to variations in dimensional tolerances of the various components, the distance between the underside of the flange and the edge of the cylinder body will vary and thus, at the moment of mounting of the steel snap ring, the correct dimension thereof will have to be selected in all cases. This is laborious and time-consuming.

A cylinder with a close-off member mounted thereon is also known from German patent document DE 44 33 649 A1.

This document shows a metal locking ring which is attached in a peripheral groove on the outer surface of the close-off member, a separate metal spring ring being present between the locking ring and the front end of the cylinder in the mounted state of the close-off member.

DE 44 33 649 A1 has the same drawback as U.S. Pat. No. 6,263,779: the locking ring and the spring ring are placed only once the close-off member is already coupled to the cylinder body.

Furthermore, DE 44 33 649 A1 has the drawback that mounting of the close-off member is only possible by introducing the close-off member via a first open end in the cylinder into the interior thereof and subsequently by displacing the cylinder to the second open end of the cylinder to which the close-off member has to be fastened. This has the consequence that a close-off member can be mounted merely on one side of the cylinder.

In addition, it is a drawback both of U.S. Pat. No. 6,263,77 and of DE 44 33 649 A1 that dirt will be able to collect at the location of the steel snap ring. On the one hand, that can be dirt which is entrained at the moment when the snap ring is placed; on the other hand, that can be dirt which will be able to accumulate in the gaps which are present between the flange and the snap ring, between the edge and the snap ring, and in the region of the division seam in the steel snap ring. This is very disadvantageous, in particular when the hydraulic cylinder is used in a medical application, for example for a hydraulically adjustable hospital bed. Cleaning of the hydraulic cylinder is then impeded, as the dirt is situated in locations which are very difficult to reach and cannot be removed or can be removed only with difficulty.

OBJECT OF THE INVENTION

The object of the present invention is to provide a hydraulic cylinder with which the aforementioned drawbacks are, at least partly, solved.

SUMMARY OF THE INVENTION

This object is achieved by the present invention by providing a hydraulic cylinder comprising:

- a cylinder body which has an open end with an opening and an edge extending therearound, which cylinder body also has an inner surface;
- a piston rod which is movable back and forth in a cylinder space;
- a close-off member which has an insert part, which insert part protrudes in a fitting manner into the open end of the cylinder body, which insert part has an outer circumferential face, wherein the close-off member also has a flange opposing the edge of the cylinder body;
- coupling means which are operable between the inner surface of the cylinder body and the outer circumferential face of the insert part for securing, in at least one axial direction, the close-off member in the cylinder body, and
- a clamping ring which is clamped between the flange and the edge at the open end of the cylinder body,
- wherein the clamping ring is made of a resilient, compressible material, and in that the clamping ring is clamped, when compressed in the axial direction, between the flange and the edge at the open end.

The invention proposes using a peripheral clamping ring made of resilient, compressible material instead of the steel snap ring containing a division seam. As a result, the way in which the cylinder is produced can be greatly simplified and the drawbacks in the field of soiling (hygiene) can be eliminated. In particular, the clamping ring can already be placed on the close-off member before that close-off member is inserted into the open end. This does not necessitate any particular equipment and the placing of the clamping ring can be carried out at an earlier moment than the coupling of the close-off member. The clamping ring is compressed in the axial direction during this mounting, so that good coupling between the coupling means can be attained. In addition, the clamping ring, which is clamped in a state compressed in the axial direction and between the flange and the open end, will exert on the closing member a force which strengthens the coupling between the cylinder body and close-off member. In addition, as a result of the fact that the clamping ring is clamped in compressed form between the flange and the open end, there will be no play, that is to say, no gaps between the clamping ring and flange, on the one hand, and/or the clamping ring and open end, on the other hand, and thus no dirt can accumulate therein. This is particularly advantageous in medical applications, where for example an autoclave is used in order, for example, to clean the bed with the hydraulic cylinder(s). In addition, the invention allows a close-off member to be mounted on both sides of a cylinder (body).

The invention also provides a method according for manufacturing a hydraulic cylinder having a cylinder body and close-off member to be coupled thereto, which method includes:

- providing a cylinder body having an open end, wherein the cylinder body comprises in an inner surface thereof a first peripheral groove distanced from the open end;
- providing a close-off member with an insert part which is suitable for being received in the open end of the cylinder body, the insert part having an outer circumferential face, the close-off member also having a flange which comes to oppose the edge at the open end of the cylinder body, and a second peripheral groove being provided in the aforementioned outer circumferential face;
- attaching a coupling ring in the second groove;
- attaching a clamping ring made of a resilient, compressible material, around the outer circumferential face of the close-off member against the flange;
- feeding, with the insert part in the open end of the cylinder body, the close-off member and further displacing therein, with compression of the clamping ring between the flange and the edge of the open end of the cylinder body, until the coupling ring couples with the first peripheral groove; and
- subsequently releasing the close-off member so that the close-off member is secured in the cylinder body.

In particular, the method provides the possibility of coupling the cylinder body and the close-off member directly to each other, wherein the only operation which has to be carried out is the telescoping of both components and causing them to couple with each other by means of the coupling means provided. Both the cylinder body and the close-off member can be fully provided with all the required components prior to the mutual coupling. This greatly simplifies the assembly process and the risk of entrapment of dirt and the risk of errors during assembly are reduced to a minimum.

These and other aspects, features and advantages of the present invention will be discussed hereinafter in greater detail with reference to the drawings.

DETAIL DESCRIPTION OF PREFERRED EMBODIMENTS

Figure 1:
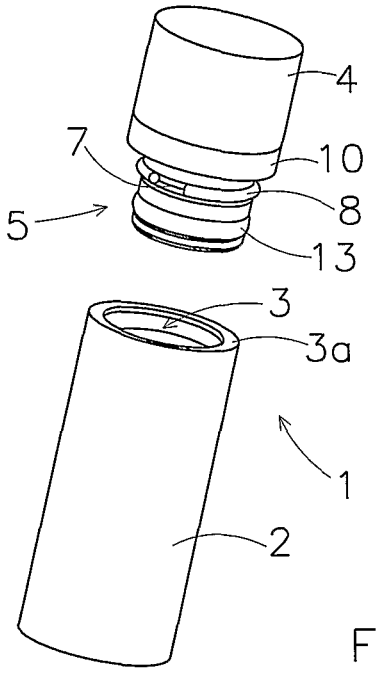
FIG. 1 is an exploded drawing in a three-dimensional representation of a hydraulic cylinder according to the invention.

FIG. 1 is a three-dimensional representation, with exploded parts, of a portion of a hydraulic cylinder denoted in its entirety by reference numeral 1. The cylinder 1 has a cylinder body 2 which at one end is closed off by a close-off member 4 which will be described in greater detail. A gland, through which the piston rod (not shown) of the hydraulic cylinder protrudes, is attached to the cylinder body 2 at the other end (not shown). The cylinder body 2 is made of a suitable metal, preferably of aluminium, preferably by extrusion of the cylinder body as tubing having a uniform cross section longitudinally, which tubing subsequently undergoes one or more treatments.

The cylinder body 2 has an open end 3 with an opening and an edge 3*a* lying therearound. On the inside, the cylinder body 2 has an inner surface.

The close-off member 4 has an insert part 5 which is configured to be introduced into the open end 3 of the cylinder body 2. Furthermore, the close-off member 4 comprises a flange or shoulder 9 having a cross section which is larger than the cross section of the insert part 6. Preferably, the outer diameter of the flange 9 corresponds to the outer diameter of the cylinder body 2.

A clamping ring 10, which, as will be described hereinafter in greater detail, is made of a resilient, compressible material, preferably made of an elastomer, is attached over the insert part 6 and against the flange 9.

The cylinder body is provided on its inner surface with a first peripheral groove 14.

The close-off member 4, in particular the insert part 5 thereof, has an outer circumferential face 6 which is provided with a second peripheral groove 7, wherein a coupling ring 8 is attached. The coupling ring 8 is preferably embodied as a steel snap ring with a division seam.

The first groove 14 forms, as will be described hereinafter, together with the second peripheral groove 7 and the coupling ring 8, which is then located in both grooves, a mechanical coupling, which is resistant to the forces occurring during use of the hydraulic cylinder, between the close-off member 4 and the cylinder body 2. No other mechanical coupling between the close-off member 4 and the cylinder body 2 is present.

A third peripheral groove 12, wherein a ring seal, in this case an O-ring 13, is received, is provided in the outer circumferential face 6 in proximity to the end 11 of the insert part 5 that is directed inward in the cylinder.

In particular, the second peripheral groove 7 and the first peripheral groove 14, which is formed in the inner surface of the cylinder body 2, form a space for receiving the coupling ring 8 which is received therein in a form-fitting manner in a coupling between the close-off member 4 and the cylinder body 2.

The assembling, in other words the coupling of the close-off member 4 and the cylinder body 2 will now be described with reference to FIGS. 2 to 6. As will become apparent, the close-off member can be connected to the cylinder body of the hydraulic cylinder in a very simple manner by means of a sort of snap connection.

Figure 2:
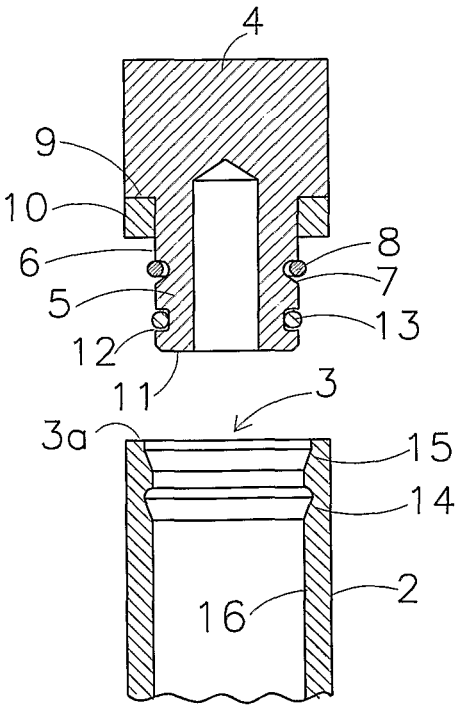
FIG. 2 is a schematic view in cross section of a starting position of the close-off member during coupling to a cylinder body.

FIG. 2 shows a starting position of a method of this type, wherein the close-off member 4 is located outside the open end 3 of the cylinder body 2 (only part of which is represented). Prior to the mounting of the close-off body 4 on the cylinder body 2, a number of components have already been mounted on the close-off member 4. The components which have been attached prior to the mounting of the close-off member are the coupling ring 8, the ring seal, in this case an O-ring, 13 and the clamping ring 10. The clamping ring 10 is in this case slid over the insert part 5 of the close-off part 4 up to the flange or shoulder 9. The coupling ring 8 and the O-ring 13 are attached in the respective peripheral grooves 7 and 12.

As will be described hereinafter in greater detail, the O-ring 13 has the function of sealing the hydraulic cylinder to prevent leakage of hydraulic fluid from the hydraulic cylinder.

The coupling ring 8 is preferably made of spring steel and is configured to be slightly compressed somewhat during introduction of the close-off member 4 into the cylinder body 2. In order to make this possible, the groove 7 has a smallest diameter which is smaller than the diameter of the coupling ring 8 when the coupling ring is in a stress-relieved state. This state is represented in FIG. 2. In order to make possible compressing of the coupling ring 8, a division is—as is preferable—formed in the coupling ring 8. This is represented in FIG. 1.

From the position represented in FIG. 2, the close-off member 4 is brought with its insert part 5 into the open end 3 of the cylinder body 2. For good guidance of the insert part 5 in the open end 3 of the cylinder body 2, said cylinder body is provided with an oblique run-in part 15 near the open end 3.

Figure 3:
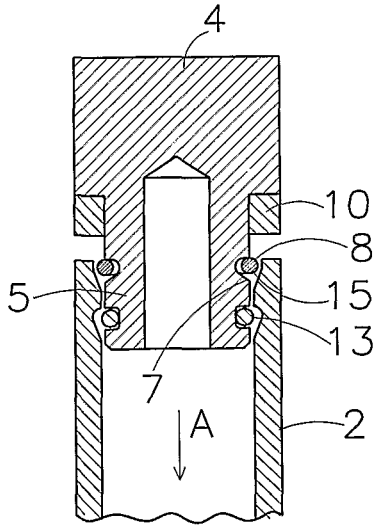
FIG. 3 is a schematic view in cross section of a second position in the coupling of the close-off member to the cylinder body.
Figure 4:
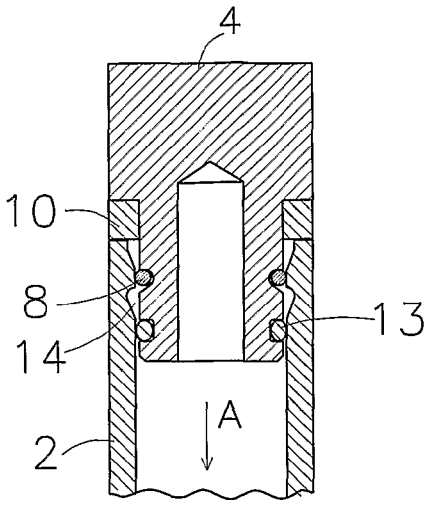
FIG. 4 is a schematic view in cross section of a third position in the coupling of the close-off member to the cylinder body.

In the position of the close-off member 4 shown in FIG. 3, the coupling ring 8 runs just up to the oblique run-in part 15. On further displacement of the close-off member 4 in the cylinder body 2, represented in FIG. 3 by an arrow A, the coupling ring 8 will be compressed so that introduction of the close-off member 4 into the cylinder body 2 will proceed smoothly. The further displacement of the close-off member 4 in the direction of the arrow A brings the close-off member 4 into the position as represented in FIG. 4. This shows that the clamping ring 10 rests just against the upper side of the open end 3. In addition, it may be seen that the coupling ring 8 is, in its most compressed state, pressed into the groove 7. As a result, it is possible for the close-off member 4 to be pressed further into the cylinder body 2 in the direction of arrow A. The O-ring 13 has in FIG. 4 in the meantime been pressed past the groove 14 and is secured between the inner surface 16 of the cylinder body 2 and the outer circumferential face 6 of the insert part 5.

As a result of the clamping-in of the O-ring 13 between the inner surface 16 of the cylinder body 2 and the outer circumferential face 6 of the insert part 5, the O-ring 13 has obtained a substantially oval cross section. As a result, the groove 12 is substantially completely filled by the O-ring 13 and very good sealing of the cylinder body 2 and thus the hydraulic cylinder 1 is achieved.

The arrangement of the O-ring 13 in the region between the cylinder space 2*a* (where the hydraulic pressure prevails during operation of the cylinder) and the co-operating grooves 7, 14 at the location of the coupling ring 8 has an important advantage, including over the solution known from U.S. Pat. No. 6,263,779. That is to say, the O-ring 13 prevents there from prevailing at the location of the grooves 7, 14 wherein the coupling ring 8 lies the hydraulic pressure which also prevails in the cylinder space 2*a*. Were the O-ring 13 to lie on the other edge of the groove 7, that hydraulic pressure would also prevail in the region of the cylinder wall where the groove 14 is provided. The thickness of the cylinder wall 2, which is reduced as a result of the presence of the groove 14, at that location would then be normative; this would lead to the cylinder wall having to be made thicker. In principle, that would then be necessary only at the location of said groove 14, but that is impractical, in particular in the case of cylinder bodies produced by extrusion as tubing.

Because the clamping ring 10 is made of a resilient, compressible material, in particular an elastomer, the close-off member 4 can be further displaced from the position shown in FIG. 4, wherein the clamping ring 10 rests against the edge 3*a* at the open end 3, in the direction indicated by arrow A. This is represented in FIG. 5.

Figure 5:
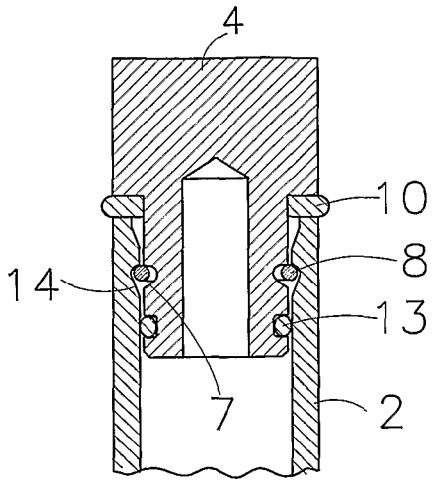
FIG. 5 is a schematic view in cross section of a fourth position in the coupling of the close-off member to the cylindrical body.

FIG. 5 shows that the close-off member 4 has been displaced into the cylinder body 2 of the hydraulic cylinder sufficiently far in the direction of the arrow A that the coupling ring 8 is received in the groove 14 which is formed in the inner surface 16 of the cylinder body 2. FIG. 5 shows that both grooves 7 and 4 in fact form a common peripheral receiving space for receiving the coupling ring 8 therein. As has just been indicated, the further displacement of the close-off member 4 in the cylinder body 2 is possible because the clamping ring 10 is compressible. On account of the compressibility of the clamping ring 10, the clamping ring 10 will exert, in the state shown in FIG. 5, on the close-off member 4 a force which tends to press the close-off member 4 back out of the cylinder body 2, that is to say, in a direction opposed to the direction of arrow A. This movement of the close-off member 4 is however counteracted by the coupling of the coupling ring 8 that is produced in the two peripheral grooves 7 and 14. This is shown in FIG. 6.

Figure 6:
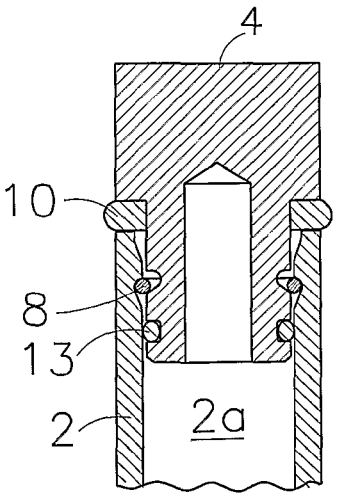
FIG. 6 is a schematic view in cross section of a last and coupled position of the close-off member to the cylinder body.

On reaching the position as indicated in FIG. 6, the coupling ring 8 rests against a substantially circular portion of the peripheral groove 14 in the inner surface 16 of the cylinder body 2 and the coupling ring 8 also rests against a substantially circular portion of the peripheral groove 7. In this way, on reaching this end position, radially directed forces are no longer exerted on the coupling ring 8. As a result of this preferred embodiment of the peripheral grooves 7 and 14, this is avoided; this is an advantage over the construction as proposed in U.S. Pat. No. 6,263,779.

A snap connection, which is in addition, as may be seen in the illustrated embodiment of FIG. 4, non-detachable, is thus produced between the close-off member 4 and the cylinder body 2. FIG. 6 also shows that the clamping ring 10 is still in a compressed state between the open end 3 and the flange 9 of the close-off member 4. This eliminates any play between the flange 9 and the open end 3 of the cylinder body 2. In particular, there are no gaps between the open end 3 and the flange 9, so that no dirt can accumulate therebetween. Preferably, in the compressed, secured position of FIG. 6, the clamping ring 10 has an outer diameter which substantially corresponds to the outer diameter of the outer body 2 and the outer diameter of the close-off member 4. In this way, a substantially flat outer surface of the assembled hydraulic cylinder 1 is provided. The latter arrangement has the advantage that cleaning of the outer surface of the hydraulic cylinder 1 can be carried out effectively, in particular in medical applications.

Figure 7:
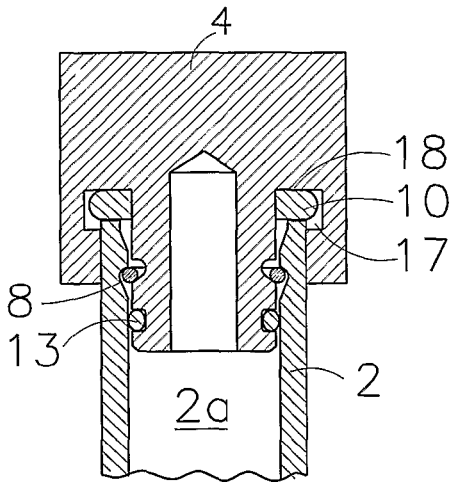
FIG. 7 is a schematic view in cross section of an alternative hydraulic cylinder according to the invention.

An alternative embodiment of the hydraulic cylinder 1 is shown in FIG. 7, wherein the close-off member 4, and in particular the flange 9, is provided with a recessed receiving groove 17 wherein the clamping ring 10 is received. The clamping ring 10 is in this case attached sufficiently far in the receiving groove 17 that said clamping ring rests on a bottom 18 of the receiving groove 17. Furthermore, the receiving groove 17 has a groove width which is such that the open end 3 of the tube body 2 can be received in the receiving groove 17.

The invention has been described herein before in the form of the attaching of a close-off member 4 to a cylinder body 2, the close-off member being configured for completely closing off the open end 3 of the cylinder body 2. However, the present invention also relates to a cylinder wherein the close-off member is configured as a gland for guiding the piston rod of the hydraulic cylinder. A gland of this type has for this purpose a feed-through opening wherein suitable ring seals or the like are provided for guiding a piston rod therethrough. The mounting of a gland of this type can be carried out in the same way as described here.

What is claimed is:

1. A hydraulic cylinder comprising:

a cylinder body which has an open end with an opening and an edge extending therearound, which cylinder body also has an inner surface;

a piston rod which is movable back and forth in a cylinder space;

a close-off member which has an insert part, which insert part protrudes in a fitting manner into the open end of the cylinder body, which insert part has an outer circumferential face, wherein the close-off member also has an integral flange opposing the edge of the cylinder body;

coupling means which are operable between the inner surface of the cylinder body and the outer circumferential face of the insert part for securing, in at least one axial direction, the close-off member in the cylinder body, and a clamping ring which is clamped between the flange and the edge at the open end of the cylinder body, wherein the clamping ring is made of a resilient, compressible material, and in that the clamping ring is clamped, when compressed in the axial direction, between the flange and the edge at the open end.

2. A hydraulic cylinder according to claim 1, wherein said resilient, compressible material is an elastomer.

3. A hydraulic cylinder according to claim 1, wherein prior to the clamping-in, the clamping ring has a substantially rectangular cross section.

4. A hydraulic cylinder according to claim 1, wherein the coupling means comprise:

a first peripheral groove, provided in the inner surface of the cylinder body distanced from the open end, and a second peripheral groove which is provided in the outer circumferential face of the insert part and has a coupling ring attached therein, for securing the close-off member in co-operation with the first peripheral groove in the cylinder body.

5. A hydraulic cylinder according to claim 4, wherein the coupling ring is circular in cross section, and wherein the first peripheral groove and the second peripheral groove each have in cross section a circular segment portion having a radius adapted to the cross section of the coupling ring, in such a way that, in the mounted state, the coupling ring rests against both circular segment portions.

6. A hydraulic cylinder according to claim 1, further comprising a ring seal which is operable between the outer circumferential face of the close-off member and the inner surface of the cylinder body.

7. A hydraulic cylinder according to claim 4, further comprising a ring seal which is operable between the outer circumferential face of the close-off member and the inner surface of the cylinder body, wherein the ring seal is arranged in the region between the cylinder space and the op-operating first and second peripheral grooves.

8. A hydraulic cylinder according to claim 6 or 7, wherein the seal is attached in a third peripheral groove which is provided in the outer circumferential face of the insert part of the close-off member.

9. A hydraulic cylinder according to claim 8, wherein the third peripheral groove containing the ring seal is formed between the second peripheral groove and the inwardly directed end of the close-off member.

10. A hydraulic cylinder according to claim 1, wherein the close-off member is a close-off cover for closing off the open end of the cylinder body.

11. A hydraulic cylinder according to claim 1, wherein the closing member is a gland with a feed-through opening provided therein for guiding the piston rod of the hydraulic cylinder and wherein sealing means are provided, which are active between the piston rod and the gland.

12. The hydraulic cylinder according to claim 1, wherein the coupling means includes a radially-compressible coupling ring.

13. The hydraulic cylinder according to claim 12, wherein the coupling ring is annular and defines a radial and axial opening, allowing compression of the coupling ring.

14. The hydraulic cylinder according to claim 1, wherein the coupling means includes a coupling ring wherein the inner surface of the cylinder body defines a first peripheral groove distanced from the open end, and wherein the outer circumferential face of the insert part defines a second peripheral groove, one of the first peripheral groove and the second peripheral groove being dimensioned to allow radial movement of the coupling ring during insertion of the insert part into the cylinder body.

15. The hydraulic cylinder according to claim 14, wherein the second peripheral groove has a depth to allow radial compression of the coupling ring during insertion of the insert part into the cylinder body.

16. The hydraulic cylinder according to claim 1, wherein the cylinder defines an axis, wherein the flange has a flange wall extending transverse to the axis, wherein the edge has an edge wall extending transverse to the axis, and wherein the clamping ring has a first surface engaging a substantial portion of the flange wall and an opposite second surface engaging a substantial portion of the edge wall in a secured condition of the close-off member relative to the cylinder body to provide a seal.

17. A hydraulic cylinder comprising:

a cylinder body which has an open end with an opening and an edge extending therearound, which cylinder body also has an inner surface;

a piston rod which is movable back and forth in a cylinder space;

a close-off member which has an insert part, which insert part protrudes in a fitting manner into the open end of the cylinder body, which insert part has an outer circumferential face, wherein the close-off member also has a flange opposing the edge of the cylinder body;

coupling means which are operable between the inner surface of the cylinder body and the outer circumferential face of the insert part for securing, in at least one axial direction, the close-off member in the cylinder body, and a clamping ring which is clamped between the flange and the edge at the open end of the cylinder body, wherein the clamping ring is made of a resilient, compressible material, and in that the clamping ring is clamped, when compressed in the axial direction, between the flange and the edge at the open end wherein the flange comprises a receiving groove which is recessed in the axial direction and wherein the clamping ring is received, and wherein the receiving groove has a groove width allowing, at least partial, reception of a cylinder wall of the cylinder body in the receiving groove.

18. A hydraulic cylinder according to claim 17, wherein the receiving groove has a groove depth which is greater than a height in an axial direction of the clamping ring.

19. A method for manufacturing a hydraulic cylinder having a cylinder body and close-off member to be coupled thereto, which method includes:

providing a cylinder body having an open end, wherein the cylinder body comprises in an inner surface thereof a first peripheral groove distanced from the open end;

providing a close-off member with an insert part which is suitable for being received in the open end of the cylinder body, the insert part having an outer circumferential face, the close-off member also having a flange which comes to oppose the edge at the open end of the cylinder body, and a second peripheral groove being provided in the aforementioned outer circumferential face;

attaching a coupling ring in the second groove;

attaching a clamping ring made of a resilient, compressible material around the outer circumferential face of the close-off member against the flange;

feeding, with the insert part in the open end of the cylinder body, the close-off member and further displacing therein, with compression of the clamping ring between the flange and the edge of the open end of the cylinder body, until the coupling ring couples with the first peripheral groove; and subsequently releasing the close-off member so that the close-off member is secured in the cylinder body.

20. The method according to claim 19, wherein attaching a clamping ring includes attaching a clamping ring made of an elastomer.

* * * * *